US008397545B1

(12) United States Patent
Lash

(10) Patent No.: US 8,397,545 B1
(45) Date of Patent: Mar. 19, 2013

(54) RESTRAINT DEVICE

(76) Inventor: James R. Lash, Artesia, NM (US)

( * ) Notice: Subject to any disclaimer, the term of this patent is extended or adjusted under 35 U.S.C. 154(b) by 205 days.

(21) Appl. No.: 12/803,567

(22) Filed: Jun. 29, 2010

(51) Int. Cl.
*E05B 75/00* (2006.01)

(52) U.S. Cl. ..... 70/16

(58) Field of Classification Search ..... 70/15–19; 43/59; 119/776, 802–804, 808; 128/878, 128/879, 882; 463/47.2, 47.4, 47.5
See application file for complete search history.

(56) References Cited

U.S. PATENT DOCUMENTS

| | | | | |
|---|---|---|---|---|
| 1,586,412 | A * | 5/1926 | Curtis | 70/18 |
| 1,803,280 | A * | 4/1931 | Stull et al. | 70/16 |
| 3,540,769 | A * | 11/1970 | Rosser | 294/119.2 |
| 3,949,514 | A * | 4/1976 | Ramsey | 43/87 |
| 3,998,459 | A | 12/1976 | Henderson et al. | |
| 4,071,023 | A | 1/1978 | Gregory | |
| 4,089,195 | A | 5/1978 | Lai | |
| 4,506,472 | A * | 3/1985 | Barman | 43/87 |
| 4,621,589 | A * | 11/1986 | Thinnes | 119/770 |
| 4,811,775 | A * | 3/1989 | Sun | 70/16 |
| 5,330,181 | A * | 7/1994 | Wong | 463/47.4 |
| 5,459,957 | A * | 10/1995 | Winer | 42/70.11 |
| 5,460,373 | A | 10/1995 | McNutt | |
| 5,482,271 | A | 1/1996 | McNutt | |
| 5,752,731 | A | 5/1998 | Crone | |
| 5,893,799 | A | 4/1999 | Studley, Jr. et al. | |
| 5,957,399 | A * | 9/1999 | Siana, Jr. | 242/377 |
| 6,026,661 | A * | 2/2000 | Spiropoulos | 70/16 |
| 6,254,561 | B1 * | 7/2001 | Borden | 602/24 |
| 6,334,444 | B1 | 1/2002 | Sisco | |
| 6,404,613 | B1 | 6/2002 | Dowling et al. | |
| 6,615,622 | B2 * | 9/2003 | MacAleese et al. | 70/16 |
| 6,963,480 | B2 | 11/2005 | Eccles | |
| 7,000,439 | B2 | 2/2006 | DiDomenico | |
| 7,029,397 | B1 | 4/2006 | Barwick | |
| 7,210,317 | B2 | 5/2007 | Beane et al. | |
| 7,246,575 | B2 * | 7/2007 | Goto | 119/802 |
| 7,251,964 | B2 * | 8/2007 | Wade | 70/16 |
| 7,316,621 | B2 | 1/2008 | Tufts | |
| 7,340,926 | B2 * | 3/2008 | Kim et al. | 70/16 |
| 2008/0173048 | A1 * | 7/2008 | Kim et al. | 70/16 |
| 2010/0031709 | A1 * | 2/2010 | Kim et al. | 70/16 |
| 2012/0085135 | A1 * | 4/2012 | Louden | 70/16 |

* cited by examiner

*Primary Examiner* — Lloyd Gall
(74) *Attorney, Agent, or Firm* — Paul B. Heynssens Attorney at Law, PLC

(57) ABSTRACT

A restraint device having a tubular body with a handle at one end and a telescopic extension rod at the other end which allows the overall length of the body to be selectively adjusted. A cuff is attached to a tether at the end of the rod in a non-deployed position. The tether can be released so a law enforcement officer can loosely control a detainee. Electrical circuitry in the body is connected to electrodes on the lower end of the handle and on the cuff so a disabling charge can be delivered. The device is also useful to civilians as a protective device when jogging, walking, bicycling or the like.

8 Claims, 3 Drawing Sheets

RESTRAINT DEVICE

FIELD OF THE INVENTION

The present invention relates to a restraint device and more particularly relates to a device for physically restraining an individual as well as for selectively applying an electrical shock to control a combative or resistive individual or to deter or repel an attack by an individual or an animal. The device may be utilized by law enforcement personnel as well as by joggers, hikers, bicyclists, animal control officers and others.

BACKGROUND OF THE INVENTION

There are various non-lethal control, defensive or restraining devices used by law enforcement and others to restrain and control detainees or to ward off an attacker. The simplest of these restraint devices are handcuffs, manacles or shackles which have been available and have been used for many years. Manacles are placed about the wrists of an individual or, in some cases, also placed about the ankles to restrict freedom of motion. While handcuffs and manacles are effective, an individual or detainee, in some instances, can free himself or herself from these devices either by disabling the lock or by manipulation in a manner to free the wrists or ankles.

More recently other devices have been developed to either restrain or temporarily incapacitate an individual. Aerosol defense sprays containing Capsicum or tear gas are well known. Stun guns use batteries to supply electricity to a circuit which includes multiple transformers which boost the voltage and reduce the amperage and which charge is stored in a capacitor. The capacitor builds up and stores the electrical charge and, upon activation, releases the charge to electrodes which is placed in contact with an individual, causing temporary interference with the individual's nervous system and muscular control to incapacitate the individual.

A variation of the stun gun is the more recently developed Taser gun. Taser devices work in the same basic way as stun guns, except the electrodes are positioned on the end of conductive wires attached to the electrical circuit of the Taser device. When activated, gas pressure launches the electrodes and the attached wires. Small barbs are affixed to the electrodes so that they will attach to the individual's body or clothing. Electrical current travels through the conductive wires, stunning the individual in basically the same way as a conventional stun gun.

A main advantage of a Taser device is that individuals can be brought under control at distances of up to 20 feet. Being able to maintain a distance or space between a detainee or would-be assailant, significantly decreases the risk to law enforcement personnel or intended victims.

While, as mentioned above, devices such as handcuffs, manacles, shackles, aerosol spray, stun guns and Taser guns are effective in many situations, they all inherently have certain disadvantages. Accordingly, there exists a need for an effective restraint and control device which law enforcement and other individuals can use to restrain an individual while maintaining a space between the individual and law enforcement personnel. Further, there exists the need for a device of this type which can both provide physical restraint without electrical shock or in the case of more extreme resistance by a detainee, can also apply electrical shock to temporarily disable the individual. While the device has principal application to law enforcement, the device may also be used by civilians as a protective safety device in the event of an attack or threatened attack, as well as by animal control personnel.

BRIEF SUMMARY OF THE INVENTION

Briefly, the present invention provides a restraint and control device having an insulated handle at the upper or proximal end and a rod at the distal end which rod is telescopic within the handle so that the overall length of the restraint device can be adjusted. A lockable manacle or cuff is secured to the end of a tether. The manacle or cuff has a fixed arcuate section and a pivotal arm which is engageable in a lock on the fixed section to encircle the limb of an individual. The tether is a wire of stainless steel or other strong material which also serves as an electrical conductor. The end of the tether opposite the cuff is secured to a retractor within the handle. In the retracted position, the cuff is secured at the end of the telescopic rod so that the cuff and the restraint device are an integral, rigid assembly and the tether is fully retracted on to the retractor. In this position, the restraint and control device is rigid and can be attached to the limb of an individual at the cuff or manacle so the movements of the individual can be restrained and controlled by a law enforcement or other individual using the handle while still maintaining the restrained individual at a safe distance.

The tether can be released to free the cuff from the end of the rod. In this deployed position, the restrained individual will have more freedom of movement, but can still be controlled while maintained at a greater distance from the law enforcement or other individual.

The upper end of the handle of the restraint and control device houses a battery, transformer, capacitor and circuitry common to stun devices. This circuitry is connected to electrodes on the exterior of the distal end of the rod, as well as electrodes located within the cuff. A trigger, preferably within a trigger guard on the handle, can be operated to cause a high voltage, low amperage discharge to the electrodes which will deliver a disabling or stunning shock to the individual. The electrodes on the distal end of the rod will deter a detainee from attempting to grab the rod to wrestle it away from law enforcement personnel or other user.

BRIEF DESCRIPTION OF THE DRAWINGS

The above and other advantages and objects of the present invention will become more apparent when taken in conjunction with the following description, claims and drawings in which:

DETAILED DESCRIPTION OF THE DRAWINGS

Figure 1:
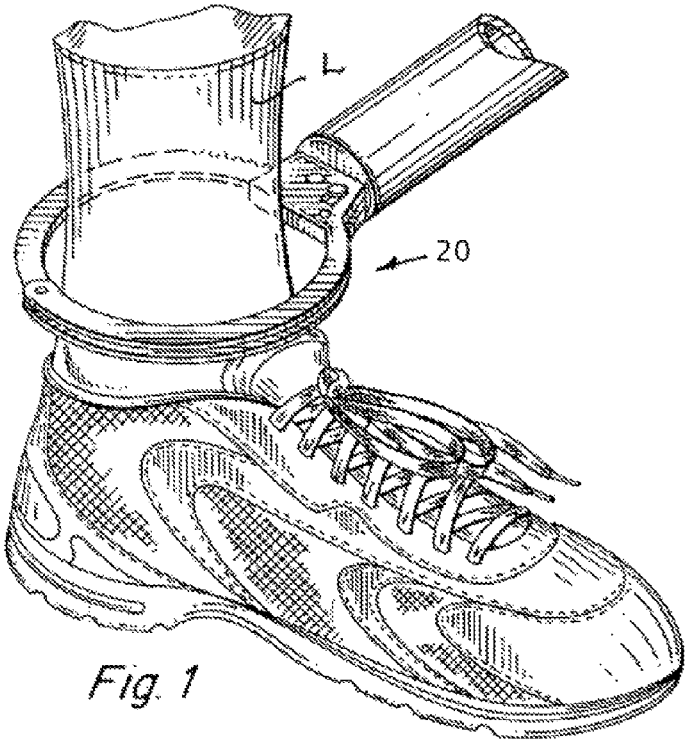
FIG. 1 is a partial perspective view showing the cuff on the distal end of the restraint device secured about the limb of a detainee.
Figure 2:
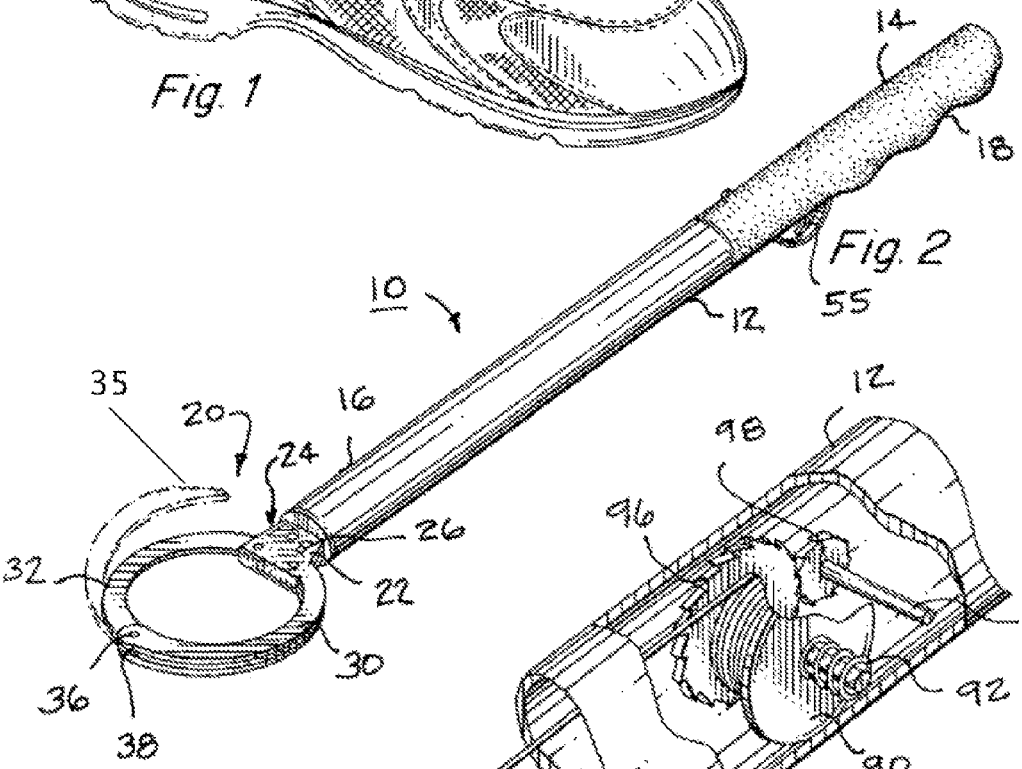
FIG. 2 is a perspective view of the restraint device of the present invention shown in a retracted, rigid position.
Figure 3:
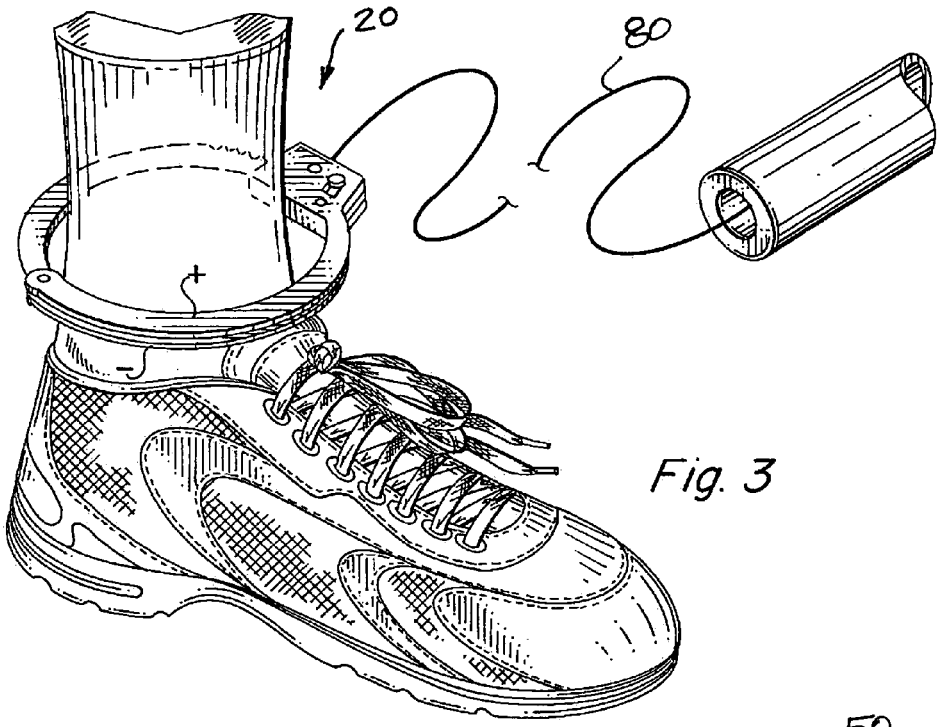
FIG. 3 is a partial perspective view showing the distal end of the restraint device of the present invention secured about the limb of an individual in a position with the tether deployed.

Turning now to the drawings, particularly FIGS. 1, 2 and 3, the restraint device of the present invention is shown and is generally designated by the numeral 10. The restraint device 10 has an elongate, generally tubular body 12 having a handle 14 at its upper proximal end and a lower, distal end 16. The handle 14 is a strong, lightweight non-conductive material such as a fiberglass or a polymeric composite. The upper end of the handle 14 may be contoured having recesses 18 to receive the fingers of the user. The handle 14 may also be provided with a resilient covering, both for comfort of the user and which covering is insulated to protect the user from electrical shock.

A manacle or cuff 20 is positioned at the lower end of the body. The manacle 20 has a lock body 22, preferably of the double locking type, which has internal ratchet teeth 24 operable by a key (not shown) inserted in the lock opening 26 and rotated to open the ratchet teeth 24 and release the bolt of a double locking type lock.

A fixed, generally arcuate arm 30 extends from one side of the lock body and is pivotally secured to arm 32 at pivot 36. A torsion spring 38 may be provided at pivot 36 to bias or urge the arm 32 to the open position when the arm 32 is unlocked. The distal end of arm 32 is provided with teeth 35 which are engageable with the ratchet teeth within the lock body and, in the locked position, the arm is prevented from opening and also prevented from further tightening. Handcuff locks of this type are known to those skilled in the art.

When the cuff 20 is placed about the limb L of an individual, as shown in FIG. 1, and locked, the restraint device is rigid and can be used to restrain and control the movements of an individual. The cuff 20 can be opened at key lock 26 and the arm 32 will move to the open position under the influence of the spring 38. The user can engage the fixed arcuate section 30 about the limb of an individual and a quick, smart "snapping" wrist action will cause the locking arm 32 to be engaged in the lock so that the user does not have to bend down or come into close proximity with a restrained individual. Being able to maintain a distance from the individual to be restrained is a safety precaution and diminishes the possibility that the restrained individual can, in some manner, overcome or successfully resist restraint.

Figure 6:
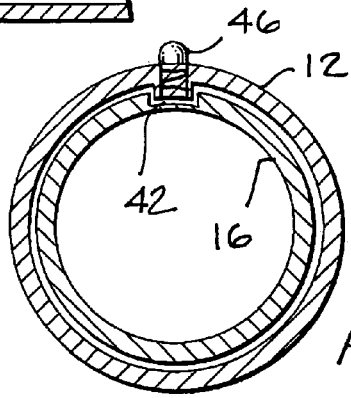
FIG. 6 is a sectional view taken along line 6-6 of FIG. 4.
Figure 4:
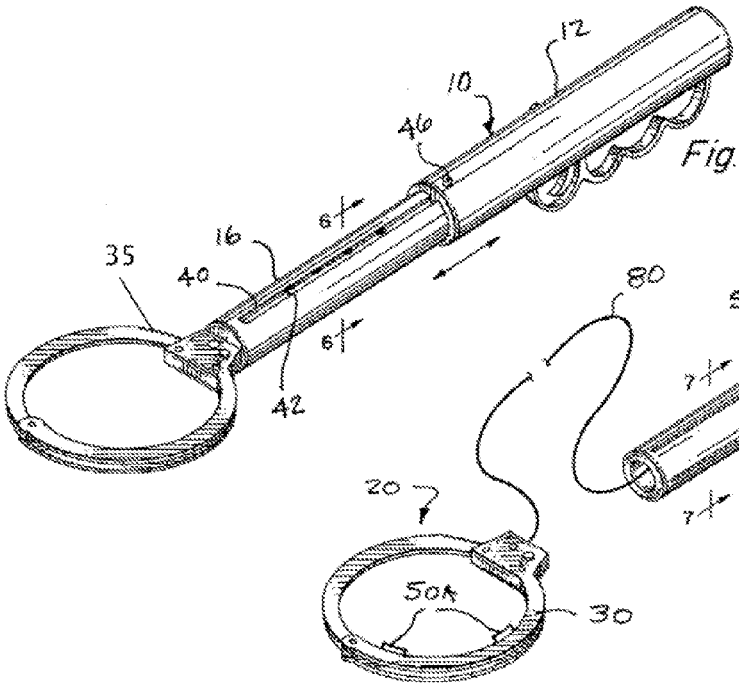
FIG. 4 is a perspective view of the restraint device of the present invention showing the telescopic extension of the rod and of the cuff from the handle.

The device may be extensible so the user may adjust the length of the body 12. As shown in FIG. 4, a lower rod end 16 is slidable within the tubular body 12. The lower rod end 16 defines a longitudinally extending slot 40 in which a plurality of bores 42 are provided. A spring-loaded detent pin 46 is provided at the lower end of the handle portion which is engageable in one of the bores to lock the rod at a selected position. FIG. 6 shows the detent pin 46 in an engaged position in one of the bores 42. The telescopic lower rod end 16 may also be adjusted by other convenient mechanisms such as an adjustable locking slip collar. The body may also be non-adjustable having a fixed length either longer for law enforcement personnel or shorter for civilian use.

Figure 8:
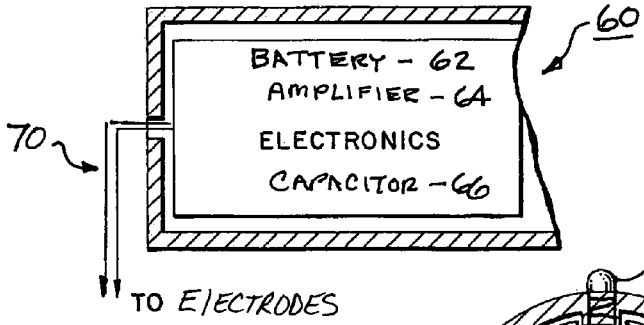
FIG. 8 is a schematic diagram showing the components of the electrical circuit housed within the handle of the restraint device as shown in FIG. 5.
Figure 7:
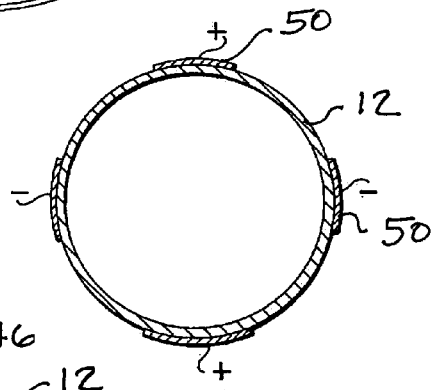
FIG. 7 is a sectional view taken along line 7-7 of FIG. 5.
Figure 5:
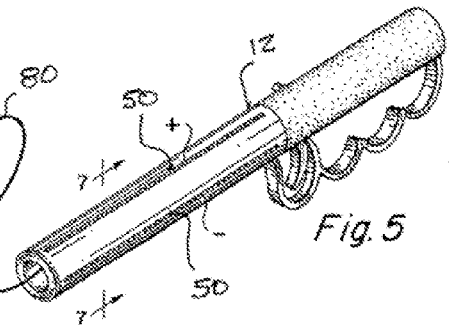
FIG. 5 is a perspective view similar to FIG. 4 showing the distal rod end retracted and the tether and cuff deployed, the rod being provided with electrodes for applying a stun or electrical shock to a detainee.

The restraint device of the present invention may also be provided with the capability of applying a high voltage, low amperage electrical charge to an individual to assist in restraining or stunning an individual who is resistive or combative. The lower end of the body 12 can be provided with two or more pairs of electrodes 50, as seen in FIGS. 5 and 7. The electrodes are connected to an electrical circuit 60 within the handle, as seen in FIG. 8. The electrical circuit including a battery 62, voltage amplifier 64 and a capacitor 66 which are conventional to stun guns and other devices such as Taser devices. The electrical circuit 60 is connected via conductors 70 to the electrodes 50 and, upon discharge, activated by a trigger 55 on the handle will send the electrical charge to the electrodes. The conductors 70 are contained within tether 80 or the tether 80 itself may serve as the conductor between the electrical circuit and the electrodes. Additional electrodes 50A may also be located on the inner side of the arms of the cuff and are shown as fixed arms 30. A safety may be provided to lock the trigger 55 and prevent inadvertent discharge. The charge delivered to the electrodes 50A on the cuff will stun the restrained detainee. The electrodes 50 on the lower end of the body 12 of the device can be placed in contact with an unrestrained individual to subdue the individual. The electrodes 50 will also hold to fend off a restrained individual from attempting to grab the device and wrest it from law enforcement personnel or other user.

Figure 9:
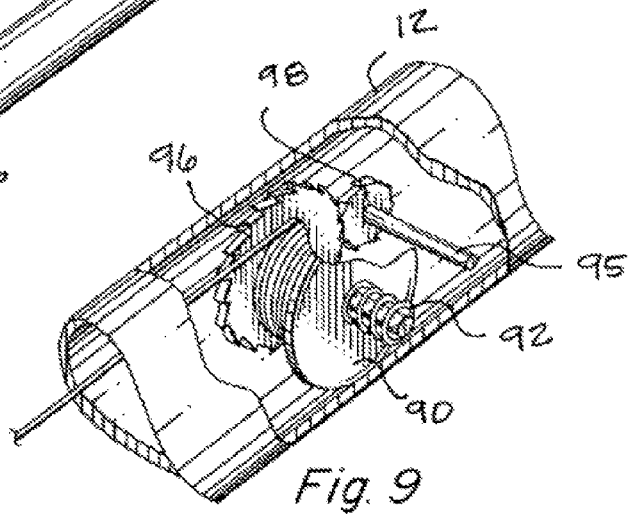
FIG. 9 is a detail view of the handle broken away to illustrate the retractor in the handle of the device for deploying and taking up the tether.

Another feature of the present invention is that the restraint allows the handle to be loosely tethered to the restrained individual. In this way, the law enforcement officer or other user may maintain a greater distance from the detained individual, but still may maintain control of the detained individual. A strong tether cable 80 is connected to the cuff 20, as seen in FIG. 3. The cable is a stainless steel or other wire that extends through the lower rod into the upper handle and may incorporate electrical conductors 70 to the electrodes 50, 50A. The upper end of the body 12 houses a spring-loaded retractor spool 90 upon which the cable is wound. Spring 92 will urge the spool in a direction to wind the cable on the spool. When the law enforcement officer or other user wishes to deploy the cable, a release 95 will disengage the teeth on the ratchet 98 from the teeth 96 on the spool, allowing the spring-biased spool to freely rotate to pay out or deploy cable 80 when the handle is pulled and the tether cuff engaged about the limb of an individual. Thus, the user can allow the connecting tether cable to extend to a desired length at which point the spool will be locked by ratchet teeth 98 engaging the release maintaining the cable at the desired length in a taut condition. The spool can be unlocked allowing the spring-biased spool to rewind the cable to return the cuff to the position shown in FIG. 2. The user can allow the spool to fully rewind the tether, placing the cuff in a secured position at the lower end of the body. The cable spool 90 is shown in detail in FIG. 9, although other retractor mechanisms including a manually windable retractor spool can be used.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. A restraint device comprising:

an elongate, generally tubular body having an upper and lower end;

a lockable cuff having a non-deployed position at the lower end of the body, the cuff including at least one electrode;

a tether coupled at one end to the cuff;

a retractor coupled to the other end of the tether, the retractor being configured to wind up and pay out the tether;

the cuff and tether both having a deployed position in which the cuff remains coupled to the tether and is released from the lower end of the body;

a release for releasing the tether to the deployed position; and at least one conductor contained within the tether, the at least one conductor operatively coupled at one end of the tether to a power through electric circuit, and the at least one conductor operatively coupled at the other end of the tether to the at least one electrode so that a charge may be delivered by the at least one electrode to stun a detainee.

2. The restraint device of claim 1 wherein the elongate, generally tubular body further comprises at least one electrode coupled to the power supply.

3. The restraint device of claim 1 wherein the lower end of the elongate, generally tubular body is telescopically extendable.

4. The restraint device of claim 1 wherein the upper end of the elongate, generally tubular body includes an insulated handle configured to receive the hand of a user.

5. The restraint device of claim 1 wherein the delivery of a discharge from the power supply through the at least one electrode is selectively controlled by a trigger on the body.

6. The restraint device of claim 1 wherein the retractor is situated within the elongate, generally tubular body, and the retractor includes a spring-biased spool.

7. The restraint device of claim 1 wherein the cuff includes a double lock.

8. A device for restraining and controlling both humans and animals comprising:

an elongate, generally tubular body having an upper end and a lower end, the upper end including a grip area;

wherein the elongate, generally tubular body comprises a telescopic rod extensible to a selected deployed position with respect to the grip area;

a cuff, wherein the cuff has both a retracted position in which the cuff is at the lower end of the elongate, generally tubular body and a deployed position in which the cuff is released from the lower end of the elongate, generally tubular body;

at least one electrode on at least one of the cuff and the elongate, generally tubular body;

a retractor coupled to the elongate, generally tubular body;

a tether coupled to the cuff at one end and having the opposite end coupled to the retractor, the tether remaining coupled to both the cuff and the retractor when the cuff is in the deployed position; and an electrical circuit operatively configured to deliver a high voltage, low amperage charge to the at least one electrode; and wherein the tether includes at least one conductor, the at least one conductor operatively coupled at one end of the tether to the electric circuit, and the at least one conductor operatively coupled at the other end of the tether to the at least one electrode so that a charge may be delivered by the at least one electrode to stun a detainee through activation at the grip area of the elongate, generally tubular body.

* * * * *